US005387959A

United States Patent [19]

Simon

[11] Patent Number: 5,387,959

[45] Date of Patent: Feb. 7, 1995

[54] UNIT FOR DEVELOPING PHOTOGRAPHIC PAPER

[75] Inventor: Joachim Simon, Erkrath, Germany

[73] Assignee: Hostert GmbH, Germany

[21] Appl. No.: 944,692

[22] Filed: Sep. 14, 1992

[30] Foreign Application Priority Data

Sep. 24, 1991 [DE] Germany ..... 9111897

[51] Int. Cl.[6] ..... G03D 3/08

[52] U.S. Cl. ..... 354/319; 354/321

[58] Field of Search ..... 354/316, 319, 320–322, 354/331, 337, 339, 340, 341, 342; 355/27–29, 72; 242/203, 204, 206, 207, 208, 209; 226/24, 119, 152

[56] References Cited

U.S. PATENT DOCUMENTS 3,599,554 8/1971 Aelterman ..... 354/319
3,724,355 4/1973 Busch et al. ..... 354/319
3,727,815 4/1973 Schwartz ..... 226/93 X
4,067,035 1/1978 Plursch et al. ..... 354/321 X
4,101,325 7/1978 Allen ..... 354/319
4,910,546 3/1990 Nonaka et al. ..... 354/321 X

*Primary Examiner*—D. Rutledge
*Attorney, Agent, or Firm*—Webb Ziesenheim Bruening Logsdon Orkin & Hanson

[57] ABSTRACT

A unit for developing exposed photographic paper is disclosed, which has several baths arranged one after the other and a drying chamber, through which the photographic paper runs continuously for developing and drying. The photographic paper is passed as a continuous sheet through each bath and the drying chamber in spiral form and with several coils. A storage unit is provided for the continuous photographic paper at least at the feed end of the unit.

6 Claims, 3 Drawing Sheets

UNIT FOR DEVELOPING PHOTOGRAPHIC PAPER

BACKGROUND OF THE INVENTION

1. Field of the Invention

The invention relates to a unit for developing exposed photographic paper, the unit having several baths arranged one after the other and a drying chamber, through which the photographic paper runs continuously for developing and drying.

2. Prior Art

It is known, when developing exposed photographic paper, to pass several sheets of this parallel to one another through the individual baths and drying chamber for the developing and drying process. However, this not only necessitates a relatively long time and equipment which requires a correspondingly large amount of space, but also requires a number of parallel strips of photographic paper to be processed simultaneously. This also means, however, that exposed photographic paper can only be developed economically in large units or quantities, in which case not only should larger quantities be processed but this should also occur practically without interruption.

The object of the invention is to provide a unit for the development of exposed photographic paper, which is also suitable for processing smaller quantities, even when these are irregular and are therefore fed intermittently.

SUMMARY OF THE INVENTION

This object is achieved with a unit of the above-mentioned kind, in which the photographic paper runs as a continuous sheet from a feed end through the baths for developing, through the drying chamber for drying and to an exit end, the photographic paper being passed through each bath and the drying chamber in a spiral form having several coils, and a storage unit for the continuous photographic paper is provided at least at the feed end of the unit.

The unit according to the invention is designed to constantly process only one strip of exposed photographic paper. As the photographic paper is passed through the individual baths in the form of a spiral, the time spent by the continuous sheet in the individual baths is relatively long. Consequently, only relatively few, and in particular relatively short baths, are sufficient and therefore the unit is shorter overall than known continuously operating photographic processing machines.

To be able to develop and dry at a continuous operating speed, the storage unit for the as yet unprocessed photographic paper, in which a specific quantity of already rolled photographic paper can be stored in zigzag or spiral form and from which the appropriate amount required for the baths is drawn off with a special extraction motor, is connected upstream of the baths. The whole system can be controlled by means of a potentiometer which is connected to a compensating roller lying on the advancing photographic paper.

It is also preferred according to the invention to connect a storage unit or cartridge upstream of the unit for a leader strip which can be connected to the trailing end of a sheet of photographic paper when no further photographic paper is to be processed. This leader strip is sufficiently long to be able to run through the entire unit so that the operating speed does not need to be decreased during the development of the photographic paper when the end of a photographic paper roll has been reached. The sheet feed or sheet transport is switched off only when the leader strip has run right through the unit and until new photographic paper is to be processed. The leader strip is neutral to the bath solutions, i.e. it is not attacked by the processing fluids, nor does it foul or impair the bath contents in any other way.

The leader strip can be rolled up at the rear of the unit according to the invention as soon as it draws a new sheet of photographic paper into the unit. The rolled up leader strip is then transferred into the leader strip storage unit connected upstream so that it stands ready for a new sheet to be drawn into the unit.

The unit is also suitable for intermittent operation, since the unit can be stopped without problem after the leader strip has been drawn in and without the throughput speed, and therefore the operating speed, having to be changed while photographic paper is being developed. The operating speed can be decreased and the unit stopped only after all the photographic paper to be developed has been processed. Hence, the unit according to the invention for developing and drying photographic paper is also suitable for processing relatively small quantities of photographic paper and only requires a relatively small amount of space.

The unit according to the invention allows capacity to be automatically adapted to the respective quantities of exposed photographic paper to be developed and dried. Therefore, intermittent operation is also economically feasible.

However, the unit is not only suitable to be operated and set up on its own, but can also be incorporated and integrated into a film processing system as a kind of module, for example, by being connected directly to an exposing unit, also referred to as a printer, via an interface.

BRIEF DESCRIPTION OF THE DRAWINGS

An embodiment of a unit according to the invention for developing and drying photographic paper is represented schematically in the drawing.

DESCRIPTION OF THE PREFERRED EMBODIMENT

Figure 1:
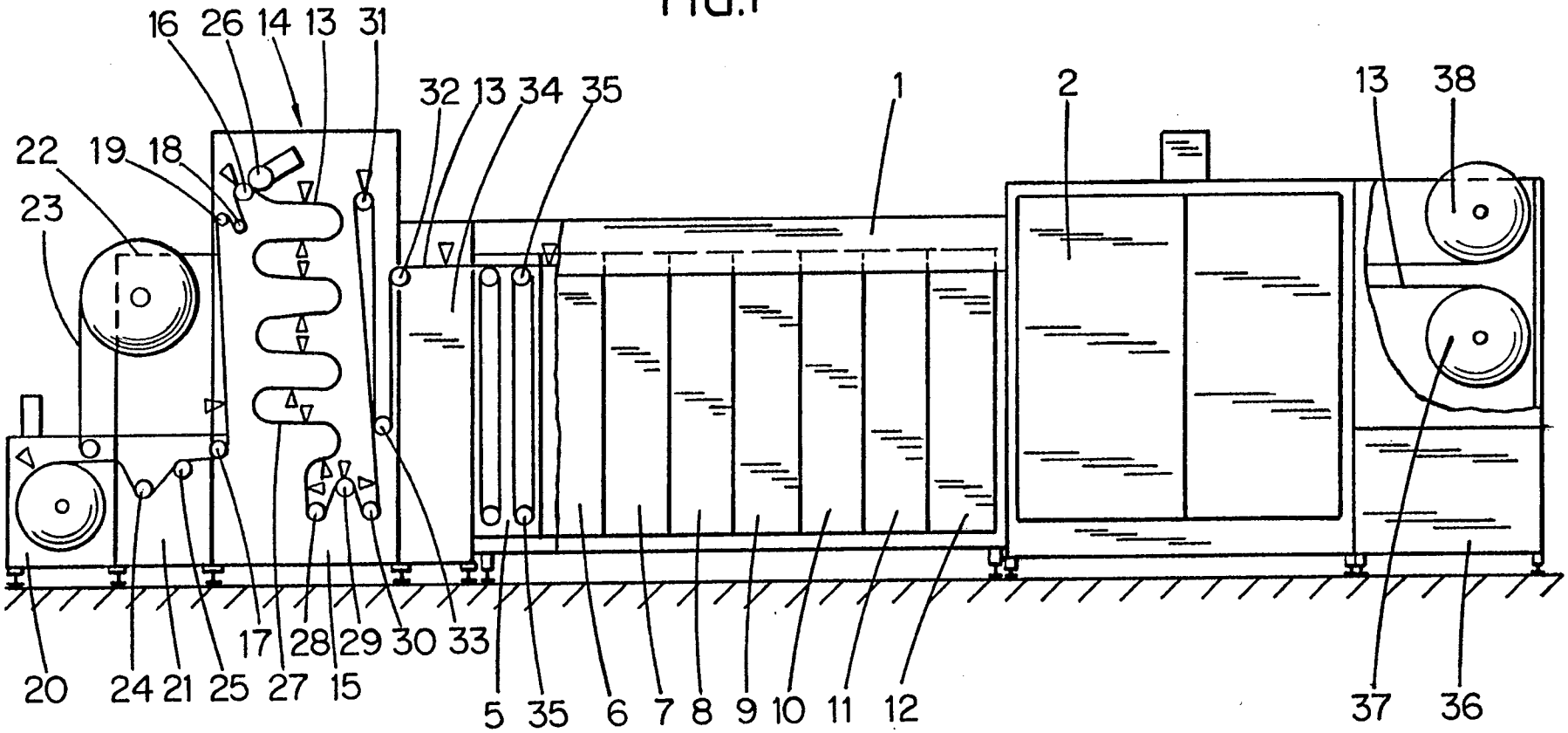
FIG. 1 shows a lateral view of the unit.

The unit for developing and drying strips of photographic paper shown in the drawing has a developing section 1 and a drying chamber 2 which are directly connected to one another.

Walkways 3, which can be reached by steps 4, are arranged on the side adjacent to the developing section 1, so that work can be carried out at the developing section and the continuous sheet running through the developing section can be monitored.

The developing section 1 has eight baths 5 to 12 here, each of which are open to the top. The first two baths 5 and 6, as seen in the direction of flow of the continuous sheets of photographic paper 13, are filled with developing fluid. The two connected baths 7 and 8 are filled with liquid fixative. The next bath 9 is used for rinsing the developed and fixed photographic paper 13, for which purpose water is slowly run through this bath. The three last baths 10, 11 and 12 are filled with water in order to complete the rinsing process and therefore remove all the developing fluid and fixative from the processed photographic paper before the photographic paper reaches the drying chamber 2.

A storage unit 14 is arranged directly upstream of the developing section 1 for the feed of the continuous strip of photographic paper 13, said unit 14 having a box-shaped closed housing 15 in which the feed of photographic paper 13 can be deposited in zigzag or meander form, as shown in FIG. 1. A feed motor 16 is arranged in the housing 15 at the feed end of same, which draws the photographic paper 13 in over upstream deflection rollers 17, 18 and 19 and deposits it inside the housing 15 in wave form, as shown in FIG. 1.

The photographic paper 13 to be developed is supplied in roll form in a closed cassette 20 which can be attached to a closed clamping box 21. A roll 22 of leader strip 23 is rotatably mounted above the clamping box 21, said leader strip 23 serves to be fastened to the trailing end of a continuous sheet of photographic paper in order to run with this through the unit and to then be at hand to draw in a new continuous sheet of photographic paper.

Inside the clamping box 21 the leading end of a new strip of photographic paper or the leading end of the leader strip 23 can be clamped to the trailing end of a strip of photographic paper.

To permit these operations to be carried out while the trailing end of the exiting photographic paper 13 is stopped, a compensating roller 24 is arranged in the clamping box. 21 so that it may be raised and lowered, and works together with a potentiometer (not shown) which controls the feed motor 16. A fixed deflection roller 25 is connected downstream of the compensating roller 24 inside the clamping box.

If the trailing end of the feed strip of photographic paper 13 is stopped to clamp on a new sheet or the leader strip 23, the compensating roller 24 is raised from the continuous sheet, which is under increased tension, and this causes the feed motor 16 to be switched off, which means no further continuous sheet is fed into the housing 15. Once the clamping process has finished, the continuous sheet is released so that the compensating roller 24 drops down again, as a result of which the feed motor 16 is switched on again and begins to draw a new continuous sheet into the housing 15.

The sheet material runs from the feed motor 16 around a further deflection roller 26 into the inside of the housing 15, where it is deposited in meander form in several coils 27. These coils 27 form a stock of paper which allows the advancing photographic paper to stop for the clamping process without the speed of passage of the photographic paper 13 through the developing section 1 and the drying chamber 2 being changed.

In the lower section of the box-shaped housing 15 a group of three deflection rollers 28, 29 and 30 is arranged, over which the continuous sheet of photographic paper 13 is passed and from which said sheet runs to an extraction motor 31 arranged above. From the extraction motor 31 the continuous sheet of photographic paper passes to a further deflection roller 32 positioned at the exit point, a further compensating roller 33 being arranged between the extraction motor 31 and the deflection roller 32, said compensating roller 33 being connected to a potentiometer (not shown) which controls the rotating speed of the extraction motor 13. If the tension in the exiting photographic paper increases, the compensating roller 33 rises, which leads to the rotating speed of the extraction motor 31 being increased in order to increase the quantity of exiting photographic paper and thus reduce the tension in the exiting photographic paper.

A scanning device 34 is connected to the housing 15 of the storage unit 14 which can monitor whether photographic paper 13 or leader strip 23 is passing through the unit. If the scanning device indicates that the leading end of the leader strip 23 is being fed in, a cut-out signal is passed to the feed motor 16 and extraction motor 31 with a time delay corresponding to the throughput speed of the continuous sheet, that is when the leading end of the leader strip has reached the exit end of the drying chamber 2.

Figure 2:
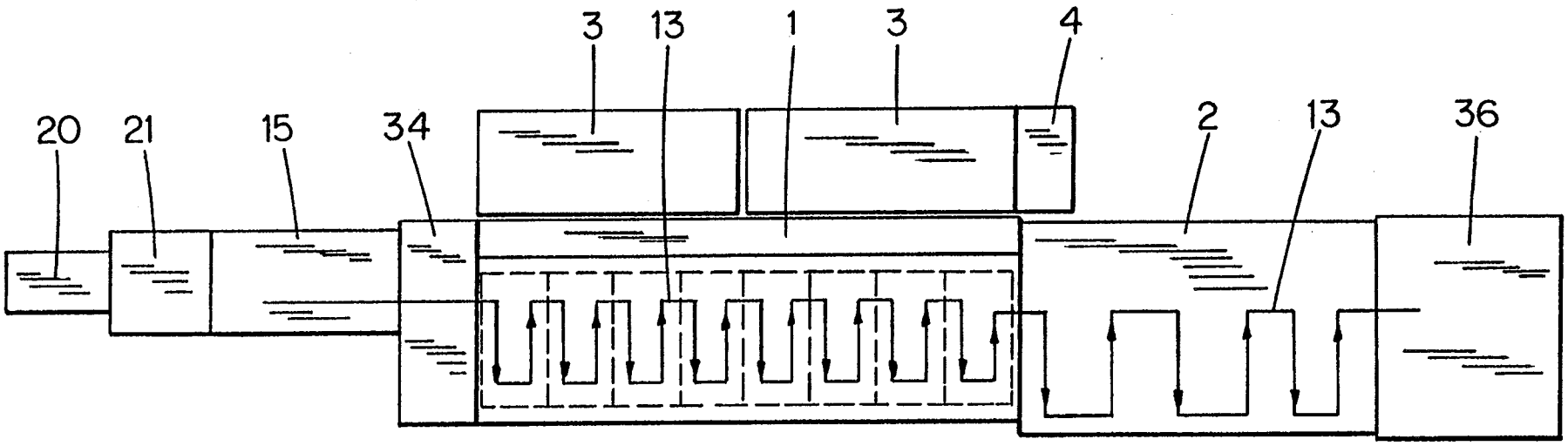
FIG. 2 shows a top view of the unit.

Two racks 35 are suspended in each of the baths 5 to 12, over which the continuous sheet of photographic paper 13 is guided in spiral form in several close coils from one side of the bath to the opposite side and back again, as indicated in FIG. 2 by the sheet of photographic paper 13 running in meander form. The photographic paper 13 is also fed through the drying chamber 2 in a similar manner, as shown in FIG. 2 by the sheet running in meander form.

A frame 36 is arranged behind the drying chamber 2 in which the developed photographic paper 3 may be rolled up to form a roll 37. A further roll 38 is arranged above the roll 37 in the frame 36 for the leader strip 23. Each roll can be provided with its own drive.

Since the sheet feed is stopped as soon as the leading end of the leader strip 23 reaches the outlet end of the drying chamber 3, the leader strip is detached from the photographic paper there and can be diverted to and wound onto its roll 38 after the sheet feed has been re-commenced by a new continuous sheet of photographic paper 13 being drawn in.

Figure 3:
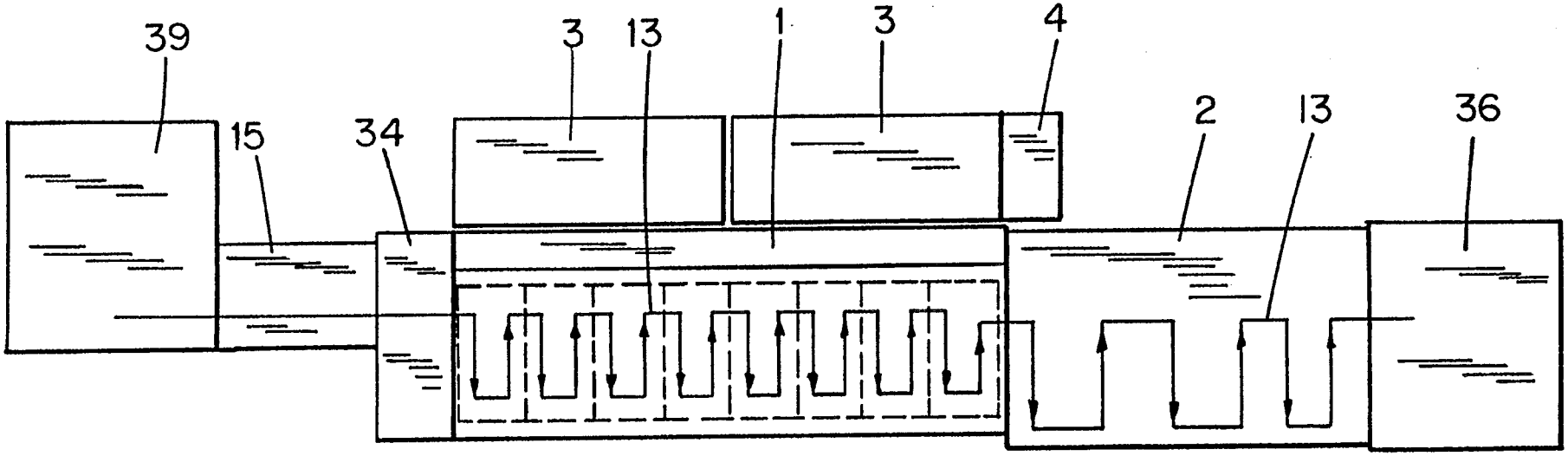
FIG. 3 shows a top view of the unit which is here connected directly to an exposing unit.

FIG. 3 shows that the unit comprising a developing unit 1 and drying chamber 2 for developing and drying exposed continuous sheets of photographic paper 3 can be connected directly with its attached storage unit 15 to an exposing unit 39, in which case an interface, which is not shown in the drawing, is provided.

What is claimed is:

1. A unit for developing exposed photographic paper, said unit having a plurality of baths arranged one after the other and a drying chamber, said photographic paper running as a continuous sheet from a feed end of said unit through said baths for developing, through said drying chamber for drying, and to an exit end of said unit, said photographic paper being passed through each said bath and said drying chamber in a spiral form having several coils, and a storage unit being provided for said continuous sheet of said photographic paper at least at said feed end of said unit, wherein said storage unit has a closed housing, means defining a feed end and an exit end of said storage unit in said housing, a first drive motor arranged at said storage unit feed end, and a second drive motor arranged at said storage unit exit end, said first and second drive motors being individually controllable.

2. A unit according to claim 1, wherein each of said first and second drive motors is controlled by a potentiometer operated by a respective compensating roller controlled by the tension in said photographic paper running through said storage unit.

3. A unit according to claim 1, wherein said housing has a free area between said first and second drive motors for accommodating a large stock of said photographic paper.

4. A unit according to claim 1, wherein two racks are suspended in each said bath and said photographic paper is guided over said racks through the said bath in meander form.

5. A unit according to claim 1, wherein a cartridge unit for a leader strip is connected upstream of said storage unit at said feed end of said unit.

6. A unit according to claim 1, wherein a further storage unit is provided at said exit end of said unit for separate rolls of developed, dried photographic paper.

* * * * *